United States Patent [19]

Davis, Jr. et al.

[11] Patent Number: 4,655,300

[45] Date of Patent: Apr. 7, 1987

[54] METHOD AND APPARATUS FOR DETECTING WEAR OF A ROTATABLE BIT

[75] Inventors: Albert P. Davis, Jr., Houston; Mark S. Ramsey, Spring; Joseph W. Stolle, Wharton, all of Tex.

[73] Assignee: Exxon Production Research Co., Houston, Tex.

[21] Appl. No.: 781,198

[22] Filed: Sep. 26, 1985

Related U.S. Application Data

[63] Continuation-in-part of Ser. No. 582,203, Feb. 21, 1984, abandoned.

[51] Int. Cl.[4] ..... E21B 12/02

[52] U.S. Cl. ..... 175/39

[58] Field of Search ..... 175/39; 73/151

[56] References Cited

U.S. PATENT DOCUMENTS 2,560,328 7/1951 Bielstein ..... 175/39

2,925,251 2/1960 Arps ..... 175/39

3,062,302 11/1962 Toth et al. ..... 175/39

3,345,867 10/1967 Arps ..... 175/39

3,853,184 12/1974 McCullough ..... 175/39

*Primary Examiner*—Stephen J. Novosad

*Assistant Examiner*—Bruce M. Kisliuk

*Attorney, Agent, or Firm*—A. J. Atkinson

[57] ABSTRACT

The present invention relates to a method and apparatus for detecting excessive wear of a rotatable bit used in drilling. In particular, the apparatus can detect loss of gauge or bearing failure in a bit. The method is accomplished by connecting a restricting means in the drill bit that can be manipulated to reduce the flow of drilling fluid through at least one port in the drill bit. A wire is connected between a sensor which senses wear and the restriction means to cause the restriction means to reduce the flow of drilling fluid and thereby signal the surface by the reduced flow as an indication of wear.

20 Claims, 6 Drawing Figures

METHOD AND APPARATUS FOR DETECTING WEAR OF A ROTATABLE BIT

This application is a continuation-in-part of U.S. patent application, Ser. No. 582,203, filed Feb. 21, 1984, now abandoned.

FIELD OF THE INVENTION

The present invention relates to a method and apparatus for detecting excessive wear of a rotatable bit used in drilling operations. In particular, the present invention relates to a method and apparatus which can detect loss of gauge of or bearing failure in a rotatable bit used to drill a wellbore.

BACKGROUND OF THE INVENTION

In oil, gas, and geothermal drilling operations, a drill bit attached to a drill stem is rotated to drill a wellbore through subsurface geologic formations. Roller-cone drill bits usually comprise a plurality of legs having a rotatable cone attached by a bearing to the spindle of each leg. Other types of drill bits such as drag-type bits do not use bearings or other moving components. As a drill bit is rotated, drilling fluid is circulated to cool the drill bit and to transport rock cuttings from the wellbore. The drilling fluid is pumped down through the drill stem, through ports in the drill bit, and up through the annulus between the drill stem and the wellbore.

A drill bit will wear as it is rotated to advance the depth of the wellbore. The length of time that a drill bit can be used before it becomes excessively worn depends on a variety of factors such as the hardness and composition of the rock and the drill stem weight that the operator places on the drill bit. The drill bit should be replaced when its rate of penetration has diminished to an unacceptable level or when torque values in rotating the drill string exceed an acceptable limit. An operator can measure the rate of penetration and the torque values from the surface.

Other factors which normally require the replacement of a drill bit cannot be measured from the surface. For example, a roller-cone drill bit should be replaced when the bit bearings are excessively worn or when the wellbore is being drilled undergauge. As the drill bit is rotated, the load-bearing surfaces between a cone and the spindle of a leg will begin to wear. As the surfaces wear, the cone will begin to rotate eccentrically about the spindle until the cone seizes, becomes excessively worn, or is separated from the spindle. In a sealed bit, the bearing will begin to fail after the seal between the cone and the spindle is damaged. If a bit bearing should fail and leave a cone in the wellbore, drilling operations are usually discontinued until the cone is "fished" from the wellbore.

Loss of borehole gauge of a roller-cone bit is due to bearing wear or to abrasion of the gauge-maintaining portion of the drill bit cones against the wellbore wall. In a drag-type bit, loss of borehole gauge is due to wear of the gauge maintaining cutters. Loss of gauge is undesirable because there is a greater possibility of differential pressure sticking between the drill string and the wellbore. Loss of gauge is especially undesirable in specialized drilling operations such as in highly deviated wells because the operator may have difficulty in maintaining directional control of the wellbore. Although loss of gauge can be reduced by hard-facing certain portions of the bit, loss of gauge remains a problem in drilling operations.

To avoid the cost of retrieving lost cones from the wellbore, most drill bits will generally be tripped out of the wellbore and replaced before the bit bearings fail. Because each drill bit is not used to the extent of its maximum useful life, this practice is costly because more drill bits are required to drill the wellbore to a particular depth. The practice of pulling drill bits "green" is particularly costly because the drill pipe and drill collars must be tripped each time that a drill bit is replaced. In deep drilling operations or in offshore drilling operations which may cost up to $130,000 U.S. per day, an operator should maximize drilling time by using each drill bit to the full extent of its useful life.

Although techniques have been proposed to detect bearing failure or loss of borehole gauge of a drill bit, the techniques are not acceptable for commercial use because the dependability of the techniques in a drilling mud environment is unproven. Therefore, a need exists for a method and apparatus to detect excessive wear of the wear surfaces in a drill bit.

SUMMARY OF THE INVENTION

The present invention provides a method and apparatus for detecting excessive wear of a drill bit connected to a drill stem which is used to drill a wellbore. A pressurized drilling fluid in the drill stem is discharged through at least one port in the drill bit and into the annulus between the drill stem and the wellbore. A restricting means connected to the drill bit can be manipulated to reduce the flow of drilling fluid through at least one port in the drill bit. An abradable sensor is connected to the drill bit at a selected location to detect excessive wear of the drill bit. A wire is connected between the sensor and the restricting means for causing the restricting means to reduce the flow of drilling fluid through a port after the sensor has been activated.

In one embodiment of the invention, a ball is released into the drilling fluid to partially or completely block a port in the drill bit. The ball may be located in a recess in the drill bit and may be propelled or released from the recess by a spring or other type of release mechanism. In another embodiment of the invention, a wire connects more than one sensor to the restriction means to detect wear at different locations in the drill bit.

DESCRIPTION OF THE PREFERRED EMBODIMENTS

Figure 1:
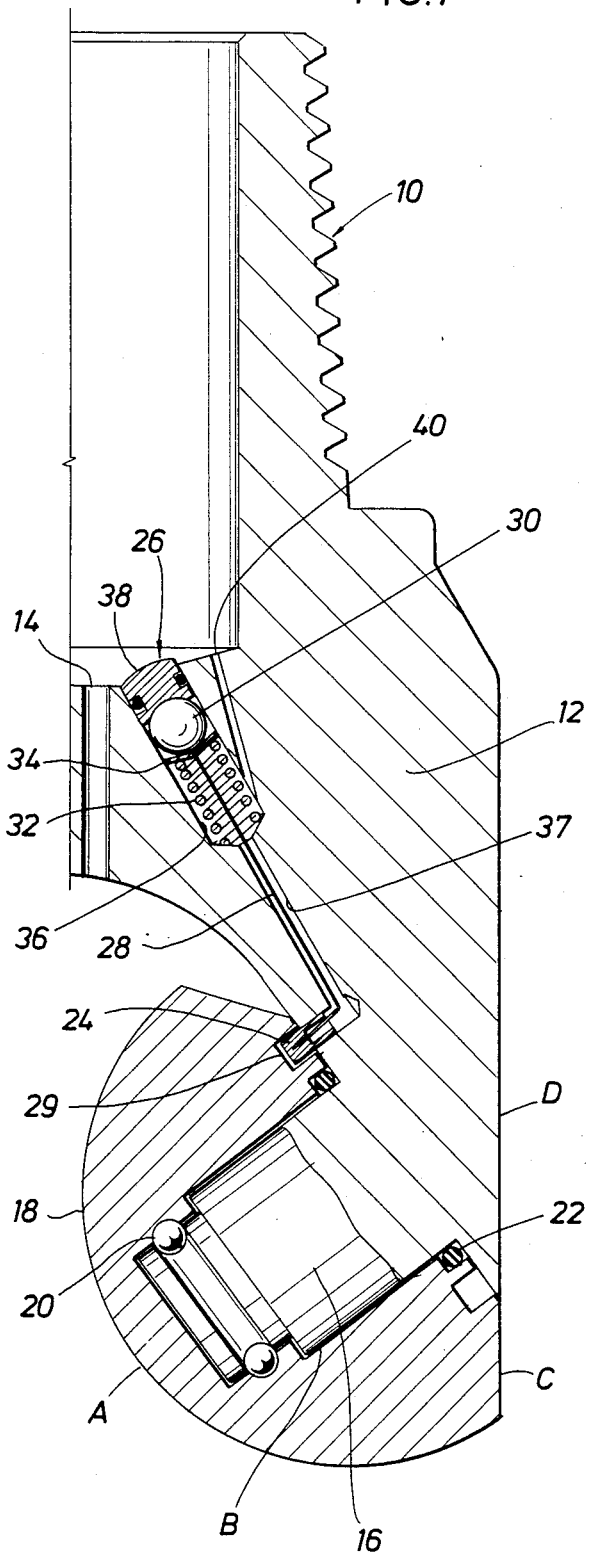
FIG. 1 illustrates a sectional view of the invention in the body of a drill bit leg wherein an abradable sensor is located to detect bearing failure.

Referring to FIG. 1, leg 10 of a sealed journal bit is shown. In most oil and gas rotary drilling operations, three legs form a drill bit. The drill bit, which is attached to the lower end of a drill stem comprised of drill collars, drill pipe, and kelly (not shown), is rotated to drill a wellbore through subsurface geologic formations. Drilling fluid is circulated down through the drill stem and is discharged through at least one port in the drill bit. The drilling fluid returns to the surface through the wellbore annulus between the drill stem and the wellbore.

Leg 10 is comprised of body 12, port 14, and spindle 16. Cone 18 is retained by bearing 20 on spindle 16. Cone surface A contains rows of steel teeth or tungsten carbide inserts (not shown) which mechanically fracture the subsurface geological formations as the drill stem is rotated. In drilling operations, spindle 16 supports cone 18 with spindle surface B as the weight of the drill stem rests on the drill bit. The interstice between spindle 16 and cone 18 is filled with grease to lubricate the bearing surfaces. Seal 22 retains the grease within the interstice.

As the drill bit is rotated to advance the depth of the wellbore and the lubrication between spindle 16 and cone 18 degrades, spindle 16 will begin to wear along surface B and the bearing surface of cone 18 will also begin to wear. As the wear of surface B and cone 18 continues, cone 18 will begin to rotate eccentrically about spindle 16. Bearing 20 may fail if wear of surface B and cone 18 continues to a point where bearing 20 cannot retain cone 18. In many cases, a cone will separate from the spindle and be lost in the wellbore. In the event of a lost cone, drilling operations are usually suspended until the cone can be removed from the wellbore.

In addition to wear along surface B and on the bearing surface of cone 18, a drill bit wears at other locations. If the outside circumferential surface of a bit has worn to a point where the diameter of the bit is less than that permitted by bit specifications, the bit is termed "undergauge." For example, a $6\frac{7}{8}$ inch diameter bit worn to $6\frac{5}{8}$ inches is undergauge. In a roller-cone bit, the outside circumferential surface is the cone gauge maintaining surface. Referring to FIG. 1, gauge maintaining surface C of cone 18 and surface D of leg 10 may experience wear, thereby causing the bit to drill undergauge. In a drag-type bit, gauge maintaining teeth prevent the bit from drilling undergauge.

The present invention detects excessive wear of a drill bit by sensing wear of the drill bit at a particular location and by manipulating a device to at least partially reduce the flow of drilling fluid through the drill bit. Referring to FIG. 1, the invention generally comprises abradable sensor means 24, restricting means 26, and wire or other communication means 28.

Sensor means 24 is connected to body 12 and extends into recess 29 in cone 18. As previously described, cone 18 will begin to rotate eccentrically about spindle 16 as wear surface B and the bearing surface of cone 18 become worn. When the eccentric rotation of cone 18 becomes sufficiently great due to wear of spindle surface B and the bearing surface of cone 18, cone 18 will gradually abrade sensor means 24 until sensor means 24 is activated.

Restricting means 26 is illustrated as comprising ball 30, spring 32, and retaining washer 34. Ball 30 is initially located in recess 36 in bit body 12. Spring 32 is located in recess 36 behind ball 30. Washer 34 is located between ball 30 and spring 32. Initially, spring 32 is held in compression by wire 28 which is fastened to washer 34 and to sensor 24. In one embodiment, wire 28 may be silver soldered, swaged, or otherwise attached to washer 34 or sensor 24. Therefore, wire 28 is preferably installed in tension through passage 37 so that spring 32 is initially compressed. Retainer cap 38 prevents drilling solids from entering recess 36. Equalization passage 40 furnishes a communication path between the inside of the drill stem and recess 36 to prevent differential pressures from developing across restricting means 26.

When sensor 24 is activated due to abrasion from cone 18, the end of wire 28 which is connected to sensor 24 will be loosened and spring 32 will be released from its initial compressed state. During the activation of restricting means 26, spring 32 will propel ball 30 from recess 36 and into the drilling fluid circulating through the drill stem. The force exerted by the drilling fluid and by gravity will push ball 30 toward port 14 until ball 30 seats against the aperture of port 14. With ball 30 in its seating position, ball 30 will reduce the flow of drilling fluid through port 14. Ball 30 and port 14 may be configured so that ball 30 prevents any fluid from being discharged though port 14. As ball 30 reduces or prevents the flow of the drilling fluid through the port, a pressure rise in the drilling fluid will be recorded by equipment (not shown) at the surface. This pressure rise notifies the operator that sensor 24 has been activated due to excessive wear of the bit. The operator can then trip the drill stem and replace the drill bit.

Figure 2:
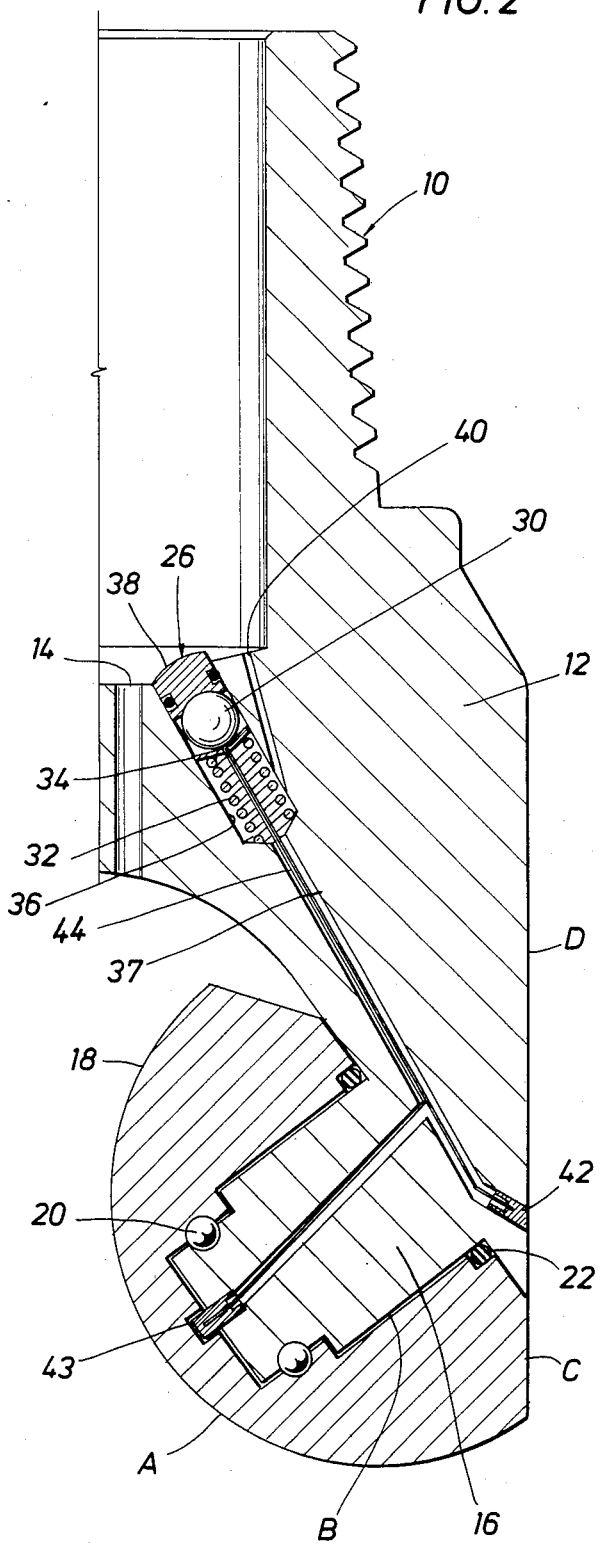
FIG. 2 illustrates an embodiment of the invention showing two abradable sensors located at different locations in the drill bit body.

In FIG. 2, abradable sensor 42 is located at the outside circumferential surface D of leg 10 to detect loss of gauge of the drill bit. Sensor 43 detects bearing failure due to abrasion by cone 18 as previously described for sensor 24. To prevent premature abrasion of sensor 43 due to solids in the drilling fluid, sensor 43 is attached to the end of spindle 16 rather than at the location shown for sensor 24. Sensors 42 and 43 are connected to restricting means 26 by wire 44. Wire 44 is attached to restricting means 26 and to sensors 42 and 43 in a manner so that activation of either sensor 42 or 43 will manipulate restricting means 26 as previously set forth. As the drill bit is rotated to advance the depth of the wellbore, wear of the drill bit due to loss of gauge will activate sensor 42 and bearing failure will activate sensor 43. Following the activation of either sensor, wire 44 will be released to manipulate restricting means 26. Therefore, excessive bit wear due to bearing failure or to loss of gauge may be separately or simultaneously detected.

Figure 3:
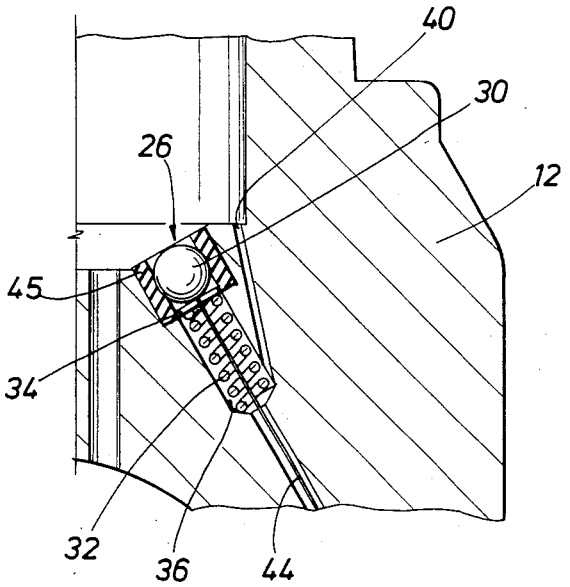
FIG. 3 illustrates a partial sectional view of a seal within the restricting means which prevents intrusion of drilling solids into a recess located in the drill bit body.

Various modifications to the preferred embodiment can be made. For example, FIG. 3 shows rubber bushing 45 located in recess 36. Bushing 45 may be used in lieu of retainer cap 38 to prevent drilling solids from entering recess 36. In addition to sensors 42 and 43, other sensors may be located in the drill bit to detect wear at points other than those illustrated. The precise location and configuration of each sensor will determine the amount of wear at the location which is deemed excessive.

Figure 4:
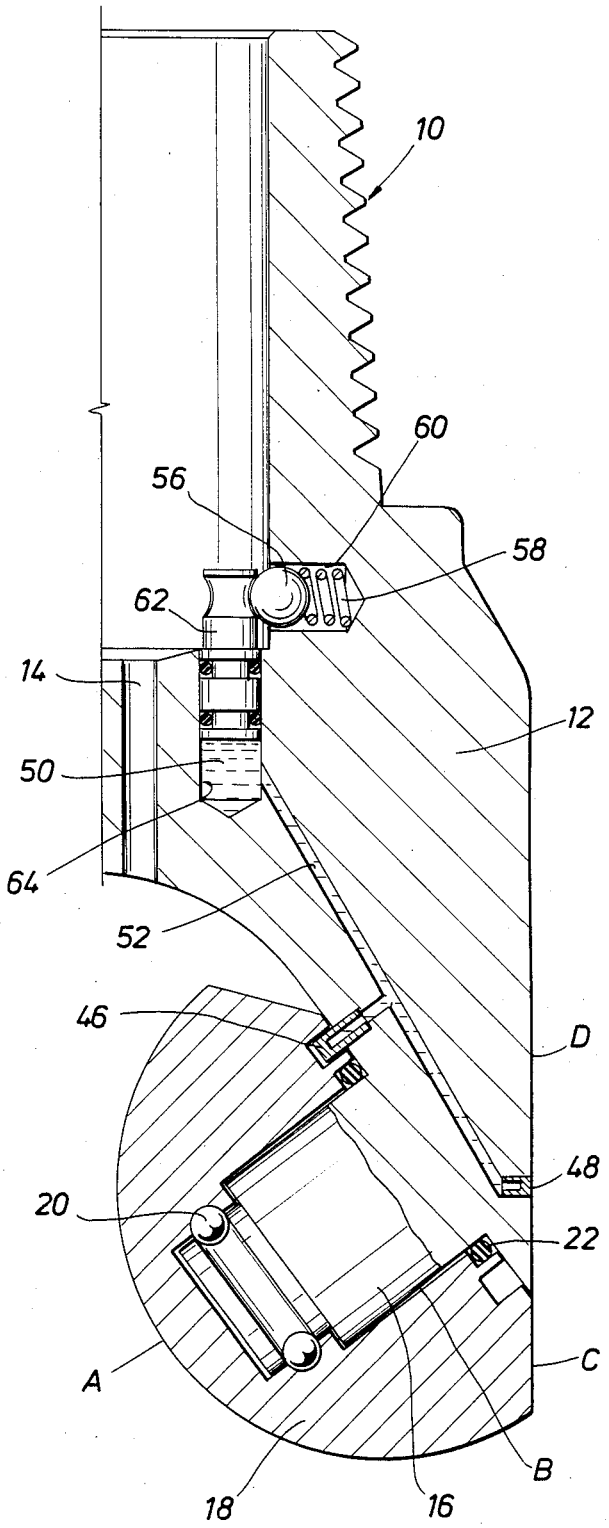
FIG. 4 illustrates a sectional view of an alternative embodiment of the invention wherein hydraulic fluid is used as the communication means and the restricting means includes a piston means located in a recess in the drill bit body.
Figure 5:
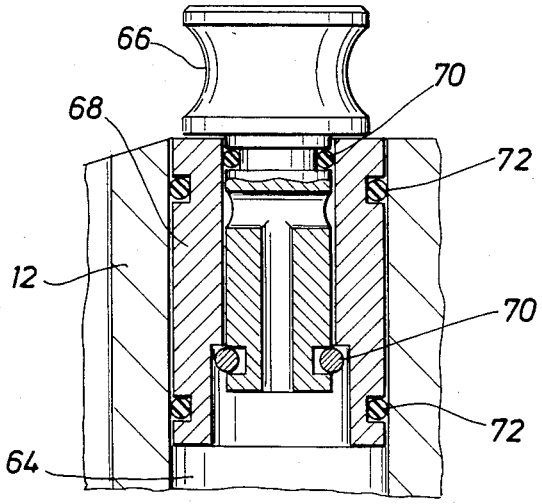
FIG. 5 illustrates an enlarged partial sectional view of the piston means shown in FIG. 4.

FIG. 4 illustrates another embodiment of the invention which is installed in leg 10. Abradable sensor 46 is located in bit body 12 to detect failure of bearing surface B. Abradable sensor 48 is located at surface D of body 12 to detect loss of gauge. In FIG. 4, the communication means is shown as hydraulic fluid 50 which is located in passages 52 through body 12. The restricting means is shown as ball 56 and compression spring 58 located in recess 60 and hydraulic piston 62 located in recess 64. Spring 58 is located behind ball 56 in recess 60 and is initially in compression. Piston 62 is initially located to retain ball 56 in recess 60. Referring to FIG. 5, one embodiment of piston 62 is shown as comprising piston head 66, ring 68, and 0-ring seals 70 and 72.

One side of piston 62 is in fluid communication with hydraulic fluid 50 in recess 64. Following the activation of sensor 46 or sensor 48 due to abrasion, hydraulic fluid 50 will leak from passages 52 and recess 64 into the annulus between the drill stem and the wellbore. The discharge of hydraulic fluid 50 is assisted by the pressure differential between the drilling fluid pressure in the drill stem and the lower pressure in the wellbore annulus. As hydraulic fluid 50 flows from recess 64, the drilling fluid pressure acting on piston 62 will force piston 62 into recess 64 until piston 62 no longer retains ball 56 in recess 60. At such point, spring 58 will propel ball 56 from recess 60 and into the drilling fluid. The drilling fluid and gravity will urge ball 56 to seat against port 14 so that the flow of drilling fluid through port 14 is reduced as previously described.

Figure 6:
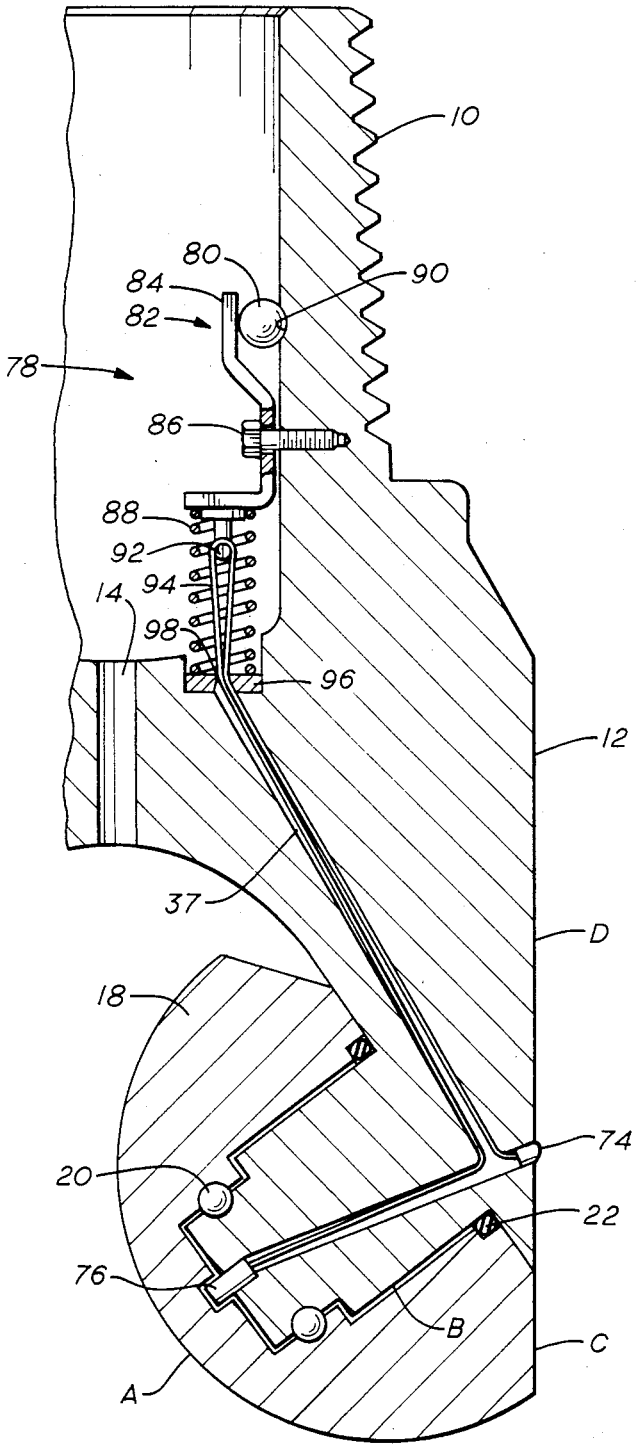
FIG. 6 illustrates a sectional view of the invention wherein the restricting means, specifically a ball and release mechanism, is generally exposed to the pressurized drilling fluid.

FIG. 6 illustrates another embodiment of the invention. Abradable sensor 74 is located at the outside circumferential surface D of leg 10 to detect loss of gauge of the drill bit. Sensor 76 detects bearing failure due to abrasion by cone 18 as previously described. Restricting means 78 is comprised of ball 80 and release mechanism 82. As illustrated, release mechanism 82 is generally comprised of lever arm 84, lever pin 86, and spring 88. Lever arm 84 retains ball 80 in a concave recess or seat 90. Pin 92 is attached to lever arm 84. Restricting means 78 is located in the flow stream of the drilling fluid to prevent solids in the drilling fluid from clogging the operable components of restricting means 78. The flow of the pressurized drilling fluid prevents impurities in the drilling fluid from attaching to the components of restricting means 78 without excessively abrading the components.

Sensors 74 and 76 are connected to restricting means 78 by wire 94. One end of wire 94 is attached to sensor 74, and the other end of wire 94 is threaded through passage 37, around pin 92, and back through passage 37 to be attached to sensor 76. During installation, wire 94 is tensioned to pull lever arm 84 against spring 88, thereby compressing spring 88. Following the activation of sensor 74 or sensor 76 due to wear of the drill bit, wire 94 will be released from tension to manipulate restricting means 78. Spring 88 will cause lever arm 84 to rotate about lever pin 86, thereby releasing ball 80 from seat 90. The drilling fluid and gravity will urge ball 80 toward port 14 as previously described.

If desired, the end of passage 37 adjacent the interior of drill bit body 12 can be partially sealed with bushing 96 to prevent the intrusion of drilling fluid into passage 37. As illustrated, compressed spring 88 retains bushing 96 against bit body 12. Bushing 96 has a small aperture 98 which is sufficiently large to permit the insertion of wire 94 therethrough. Preferably, the diametric clearance between wire 94 and aperture 98 is less than 0.004 inch to prevent solids in the drilling fluid from entering passage 37. Although FIG. 6 shows that wire 94 passes twice through single aperture 98, more than one aperture may be drilled through bushing 96 to reduce the clearance between wire 94 and aperture 98. In operation, a filter cake produced by the drilling fluid seals the clearance between wire 94 and aperture 98, thereby creating a pressure differential between the pressure of the drilling fluid and the pressure in passage 37. A pressure equalization passage such as passage 40 in FIGS. 1–3 is not necessary for this embodiment because the magnitude of the force exerted by the pressure differential is slight due to the small cross-sectional area of wire 94.

The invention furnishes a unique method and apparatus for remotely detecting excessive wear of a drill bit. The invention does not use downhole electronics or oscillating mud pulse techniques as a communication link between the drill bit and the surface. Moreover, the invention does not require operating adjustments or special handling. The invention can be used in conventional rotary drilling, positive displacement motors, or turbine assemblies. In addition, the invention can be adapted to sealed or non-sealed bits and to roller bearing, journal bearing, or drag-type bits. The invention can be used in drilling operations using an oil base, water base, or gas as the drilling fluid. Therefore, the invention is extremely versatile and is well-suited for use in drilling operations.

It is apparent that many other variations of the apparatus and method described herein may be made without departing from the scope of the present invention. The embodiments set forth herein are illustrative and should not limit the scope of the invention.

What is claimed is:

1. An apparatus for detecting excessive wear of a drill bit connected to a drill stem which is rotated to drill a wellbore, wherein a pressurized drilling fluid in the drill stem is discharged through at least one port in the drill bit and into the annulus between the drill stem and the wellbore, comprising:

a restricting means connected to the drill bit for reducing the flow of drilling fluid through at least one port;

an abradable sensor connected to the drill bit at a selected location to detect abrasion of the drill bit at said location; and a tensioned wire connected between said restricting means and said sensor for manipulating said restricting means, when said sensor is activated by abrasion of the drill bit to release the tension in said wire, to reduce the flow of drilling fluid through at least one port of the drill bit.

2. An apparatus as recited in claim 1, wherein said wire is connected between said restricting means and at least two sensors so that activation of one sensor releases the tension in said wire to manipulate said restricting means.

3. An apparatus for detecting excessive wear of a drill bit connected to a drill stem which is rotated to drill a wellbore, wherein a pressurized drilling fluid in the drill stem is dicharged through at least one port in the drill bit and into the annulus between the drill stem and the wellbore, comprising:

a ball for reducing the flow of drilling fluid through a port;

a release mechanism connected to the drill bit for releasably retaining said ball in an initial position;

an abradable sensor connected to the drill bit at a selected location to detect abrasion of the drill bit at said location; and a wire connected between said sensor and said release mechanism for manipulating said release mechanism, after said sensor has been activated, to release said ball from the initial position so that the drilling fluid urges said ball against a port to reduce the flow of drilling fluid through the port.

4. An apparatus for detecting excessive wear of a drill bit connected to a drill stem which is rotated to drill a wellbore, wherein a pressurized drilling fluid in the drill stem is discharged through at least one port in the drill bit and into the annulus between the drill stem and the wellbore, comprising:

a ball, located in a recess in the drill bit body, which is capable of being urged against the aperture of a port to reduce the flow of drilling fluid through the port;

a release mechanism connected to the drill bit for initially retaining said ball in the recess;

an abradable sensor connected to the drill bit at a selected location to detect abrasion of the drill bit at said location; and a tensioned wire located in a passage within the drill bit to connect said sensor and said release mechanism so that when said sensor is activated by abrasion of the drill bit to release the tension in said wire, said release mechanism releases said ball from the recess to permit the drilling fluid to urge said ball against a port.

5. An apparatus as recited in claim 4, wherein said release mechanism comprises a spring, held in compression by said wire, which is located in the recess between said ball and the drill bit.

6. An apparatus as recited in claim 4, further comprising a spring located in the recess between said ball and the drill bit for propelling said ball from the recess after said release mechanism has released said ball from the recess.

7. An apparatus for detecting excessive wear of a drill bit connected to a drill stem which is rotated to drill a wellbore, wherein said drill bit comprises a body and at least one rotatable cone attached by a bearing to the drill bit, and a pressurized drilling fluid in the drill stem is discharged through at least one port in the drill bit and into the annulus between the drill stem and the wellbore, comprising:

a ball, located in a recess in the drill bit, which is capable of being urged against the aperture of a port to reduce the flow of drilling fluid through the port;

a release mechanism connected to the drill bit for initially retaining said ball in said recess; an abradable sensor connected to the drill bit for detecting excessive wear of the drill bit bearing; and a tensioned wire connected between said sensor and said release mechanism for manipulating said release mechanism, when said sensor releases the tension in said wire, to release said ball from the recess so that the drilling fluid can urge said ball against the aperture of a port.

8. An apparatus as recited in claim 7, further comprising a sensor connected to the drill bit for detecting excessive wear of the outside circumferential surface of the drill bit.

9. An apparatus for detecting bearing failure in or excessive loss of gauge of a drill bit connected to a drill stem which is rotated to drill a wellbore, wherein said drill bit comprises a body and at least one rotatable cone attached by a bearing to the drill bit body, and a pressurized drilling fluid in the drill stem is discharged through at least one port in the drill bit and into the annulus between the drill stem and the wellbore, comprising:

a ball, located in a recess in the drill bit, which is capable of being urged against the aperture of a port to reduce the flow of drilling fluid though the port;

a release mechanism connected to the drill bit for initially retaining said ball in said recess;

an abradable first sensor attached to the drill bit at a selected location to detect excessive wear of the drill bit bearing;

an abradable second sensor attached to the drill bit to detect wear of the outside circumferential surface of the drill bit; and a tensioned wire located in a passage within the drill bit to connect said first and second sensors to said release mechanism so that the activation of a single sensor will release the tension in said wire, thereby manipulating said release mechanism to release said ball from said recess and into the drilling fluid to reduce the flow of drilling fluid through a port.

10. An apparatus as recited in claim 9, wherein said release mechanism comprises a spring initially held in compression by said wire and being located in the recess between said ball and the drill bit.

11. An apparatus as recited in claim 10, wherein said release mechanism is generally located in contact with the drilling fluid upstream of the port.

12. An apparatus as recited in claim 11, further comprising a bushing for reducing the amount of drilling fluid which intrudes into the passage, wherein said bushing has an aperture to permit said wire to extend from the passage to said release mechanism.

13. An apparatus as recited in claim 9, further comprising a spring located in the recess between said ball and the drill bit for propelling said ball from said recess.

14. A method for detecting excessive wear of a rotatable drill bit connected to a drill stem which is used to drill a wellbore, said method comprising the steps of:

discharging a pressurized fluid from the drill stem through at least one port in the drill bit body and into the annulus between the drill stem and the wellbore;

activating an abradable sensor connected to the drill bit at a selected location, when the drill bit becomes excessively worn at said location, to release the tension in a wire connected between said sensor and a restricting means;

manipulating said restricting means to reduce the flow of drilling fluid through at least one port; and detecting the increase in drilling fluid pressure.

15. A method as described in claim 14, further comprising the step of replacing the drill bit.

16. A method as described in claim 14, wherein said sensor detects excessive wear of the drill bit bearing.

17. A method as described in claim 14, wherein said sensor detects wear of the outside circumferential surface of the drill bit to determine whether the drill bit is undergauge.

18. A method for detecting excessive wear of a rotatable bit connected to a drill stem which is used to drill a wellbore, wherein the drill bit comprises a bit body and at least one rotatable cone attached by a bearing to the drill bit, said method comprising the steps of:

discharging a pressurized fluid in the drill stem through at least one port in the drill bit and into the annulus between the drill stem and the wellbore;

activating an abradable sensor connected to the drill bit at a selected location, when the drill bit becomes excessively worn at said location, to release the tension in a wire connected between said sensor and a release mechanism;

manipulating said release mechanism to release a ball so that the drilling fluid urges said ball against the aperture of a port to reduce the flow of drilling fluid through the port, thereby increasing the drilling fluid pressure in the drill stem; and detecting the increase in drilling fluid pressure.

19. A method as recited in claim 18, wherein said ball is urged against the aperture of the port to completely block the flow of drilling fluid through the port.

20. An apparatus for detecting excessive wear of a drill bit connected to a drill stem which is rotated to drill a wellbore, wherein a pressurized drilling fluid in the drill stem is discharged through at least one port in the drill bit and into the annulus between the drill stem and the wellbore, comprising:

a ball retained in a recess in the drill bit for reducing the flow of drilling fluid through at least one port after said ball has been displaced from said recess;

a compressed spring located in said recess between said ball and said drill bit;

an abradable sensor connected to the drill bit at a selected location to detect abrasion of the drill bit at said location; and a tensioned wire connected between said sensor and said spring for releasing said spring from compression, after said sensor has been activated due to abrasion of the drill bit, to displace said ball from said recess.

* * * * *